US011121461B2

(12) United States Patent
Sakai et al.

(10) Patent No.: US 11,121,461 B2
(45) Date of Patent: Sep. 14, 2021

(54) ANTENNA DEVICE

(71) Applicants: DENSO CORPORATION, Kariya (JP); SOKEN, INC., Nisshin (JP)

(72) Inventors: Toshiya Sakai, Nisshin (JP); Kazumasa Sakurai, Nisshin (JP); Asahi Kondo, Kariya (JP)

(73) Assignees: DENSO CORPORATION, Kariya (JP); SOKEN, INC., Nisshin (JP)

( * ) Notice: Subject to any disclaimer, the term of this patent is extended or adjusted under 35 U.S.C. 154(b) by 0 days.

(21) Appl. No.: 16/659,914

(22) Filed: Oct. 22, 2019

(65) Prior Publication Data

US 2020/0052396 A1 Feb. 13, 2020

Related U.S. Application Data

(63) Continuation of application No. PCT/JP2018/016299, filed on Apr. 20, 2018.

(30) Foreign Application Priority Data

Apr. 24, 2017 (JP) ..... JP2017-085399
Aug. 30, 2017 (JP) ..... JP2017-166031

(51) Int. Cl.
*H01Q 1/52* (2006.01)
*H01Q 1/28* (2006.01)
(Continued)

(52) U.S. Cl.
CPC ..... *H01Q 1/525* (2013.01); *H01Q 1/28* (2013.01); *H01Q 1/48* (2013.01); *H01Q 15/24* (2013.01)

(58) Field of Classification Search
CPC ..... H01Q 1/525; H01Q 21/065; H01Q 1/38; H01Q 9/0407; H01Q 19/005; H01Q 1/28; H01Q 1/52
See application file for complete search history.

(56) References Cited

U.S. PATENT DOCUMENTS 4,450,449 A * 5/1984 Jewitt ..... H01Q 1/38 343/700 MS
6,262,495 B1 7/2001 Yablonovitch et al.
(Continued)

FOREIGN PATENT DOCUMENTS

JP 3653470 A 5/2005
JP 2007243375 A 9/2007
(Continued)

OTHER PUBLICATIONS

Yang et al. "Microstrip Antennas Integrated With Electromagnetic Band-Gap (EBG) Structures: A Low Mutual Coupling Design for Array Applications", IEEE Transactions on Antennas and Propagation, vol. 51, No. 10, IEEE, Oct. 14, 2003, pp. 2936-2946.
(Continued)

*Primary Examiner* — Hasan Islam
(74) *Attorney, Agent, or Firm* — Maschoff Brennan

(57) ABSTRACT

An antenna device includes a dielectric substrate, a ground plane, an antenna unit, and an additional functional unit. The dielectric substrate includes a plurality of pattern formation layers. The ground plane is formed on a first pattern formation layer included in the plurality of pattern formation layers, and acts as an antenna grounding surface. The antenna unit is formed on a pattern formation layer that is included in the plurality of pattern formation layers and that is different from the first pattern formation layer. The antenna unit includes one or more antenna patterns configured to act as radiation elements. The additional functional unit includes one or more parasitic patterns provided on a propagation path for a surface propagating over the dielectric substrate, and causes the surface wave to generate a radiation wave with polarization different from polarization of a radio wave transmitted and received by the antenna unit.

17 Claims, 18 Drawing Sheets

(51) Int. Cl.
*H01Q 15/24* (2006.01)
*H01Q 1/48* (2006.01)

(56) References Cited

U.S. PATENT DOCUMENTS

| | | | | |
|---|---|---|---|---|
| 7,079,079 | B2 * | 7/2006 | Jo | H01Q 1/243 343/700 MS |
| 10,014,572 | B2 * | 7/2018 | Tagi | H01Q 1/521 |
| 2013/0050044 | A1 | 2/2013 | Inoue | |
| 2016/0013557 | A1 | 1/2016 | Kawaguchi et al. | |
| 2016/0028161 | A1 | 1/2016 | Kawaguchi et al. | |

FOREIGN PATENT DOCUMENTS

| | | | |
|---|---|---|---|
| JP | 2014168222 | A | 9/2014 |
| JP | 2014179680 | A | 9/2014 |
| WO | 2011136081 | A1 | 11/2011 |
| WO | 2017175835 | A1 | 10/2017 |

OTHER PUBLICATIONS

Jaglan et al., "Surface waves inimization in Microstrip Patch Antenna using EBG substrate, 2015 International Conference on Signal Processing and Communication (ICSC)", IEEE, Mar. 16, 2015, pp. 116-121.

* cited by examiner

ANTENNA DEVICE

CROSS-REFERENCE TO RELATED APPLICATIONS

The present international application claims priority of JP 2017-085399 filed at the Japanese Patent Office on Apr. 24, 2017 and JP 2017-166031 filed at the Japanese Patent Office on Aug. 30, 2017, and the entire contents of JP 2017-085399 and JP 2017-166031 are incorporated herein by reference.

TECHNICAL FIELD

The present disclosure relates to an antenna device formed using a dielectric substrate.

BACKGROUND ART

An antenna formed on a dielectric substrate is used, for example, for a radar in a moving body such as a vehicle or an airplane, the radar monitoring surroundings of the vehicle or the airplane. As is known, in such an antenna, a surface wave propagating over a substrate surface causes, at a substrate end or the like, radiation different from a main antenna radiation, leading to disturbed directionality.

A conventional technique is known which suppresses disturbance of directionality by forming, on the substrate, a structure with a bandgap inhibiting propagation of a surface wave with the operating frequency of an antenna (hereinafter referred to as an EBG structure). EBG is an abbreviation for Electromagnetic Band Gap.

SUMMARY OF THE INVENTION

However, the inventors' detailed examinations have found that the above technique encounters the following problems.

The EBG includes small hexagonal metal plates two-dimensionally periodically disposed on a front surface of the substrate and a metal plate formed on a back surface of the substrate and connected to the small metal plates via through-holes formed of metal. Accordingly, the utilization of the EBG requires formation of the through-holes in the substrate, thus complicating the structure of the substrate.

An aspect of the preset disclosure provides a technique using a simple configuration to suppress disturbance of antenna characteristics caused by a surface wave propagating over the substrate.

An antenna device according to the aspect of the present disclosure includes a dielectric substrate, a ground plane, an antenna unit, and an additional functional unit.

The dielectric substrate includes a plurality of pattern formation layers. The ground plane is formed on a first pattern formation layer included in the plurality of pattern formation layers, and acts as an antenna grounding surface. The antenna unit is formed on a pattern formation layer that is included in the plurality of pattern formation layers and that is different from the first pattern formation layer. The antenna unit includes one or more antenna patterns configured to act as radiation elements. The additional functional unit includes one or more parasitic patterns provided on a propagation path for a surface wave propagating over the dielectric substrate, and causes the surface wave to generate a radiation wave with polarization different from polarization of a radio wave transmitted and received by the antenna unit.

According to such a configuration, the surface wave is converted into a radio wave by the parasitic patterns belonging to the additional functional unit, the radio wave having polarization different from polarization of a radio wave transmitted and received by the antenna unit. In other words, not only does the surface wave attenuate in accordance with the propagation, but a radiation wave resulting from the surface wave is prevented from interfering with the radio wave transmitted and received by the antenna unit, allowing suppression of disturbance of antenna directionality based on the surface wave.

Note that parenthesized reference signs recited in claims indicate a correspondence relationship with specific means described in embodiments as an aspect, and are not intended to limit the technical scope of the present disclosure.

DESCRIPTION OF EMBODIMENTS

Embodiments of the present disclosure will be described below with reference to the drawings.

1. First Embodiment

1-1. Configuration

An antenna device 1 is used, for example, as a millimeter-wave radar configured to detect various objects present around a vehicle.

Figure 1:
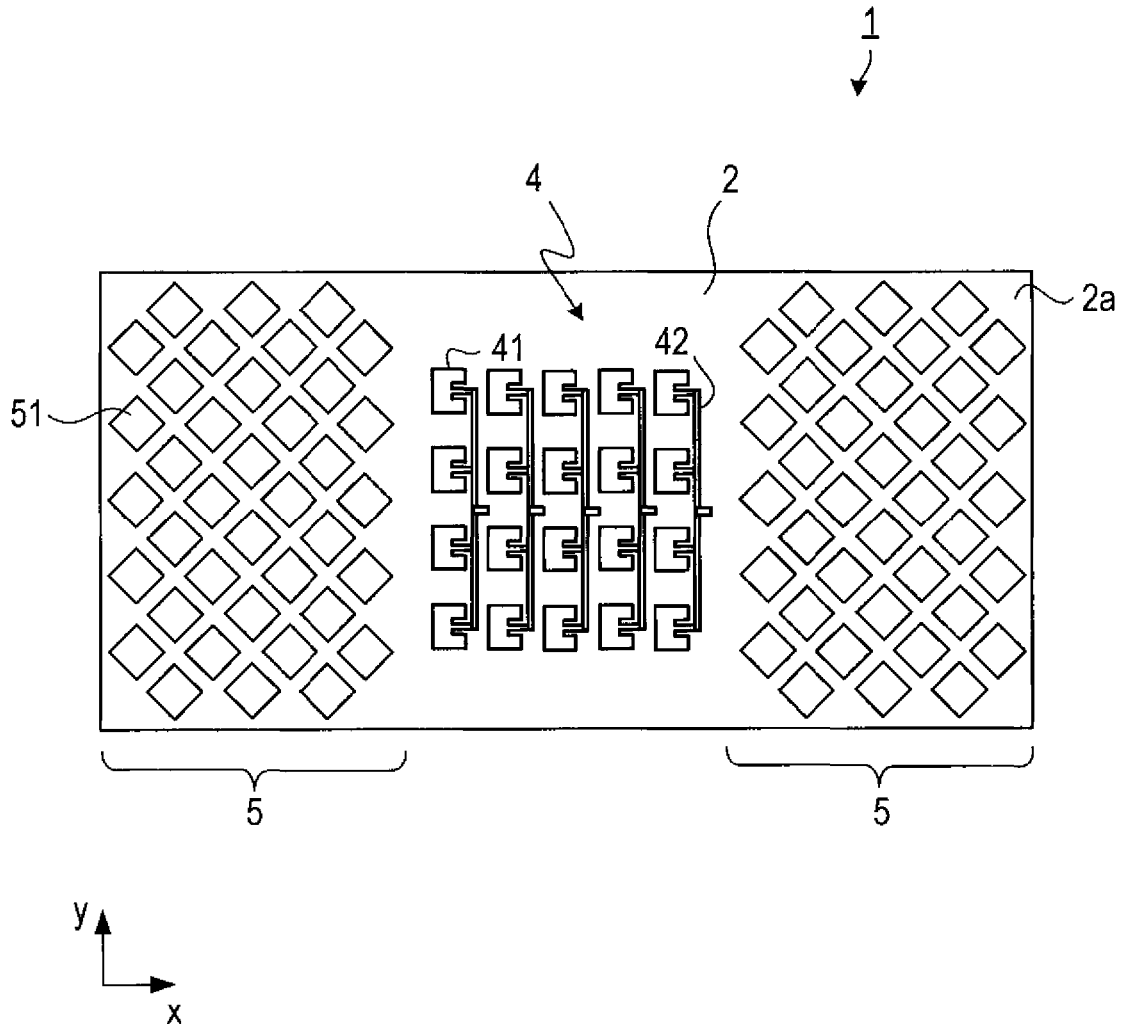
FIG. 1 is a plan view illustrating a configuration of an antenna device of a first embodiment.
Figure 2:
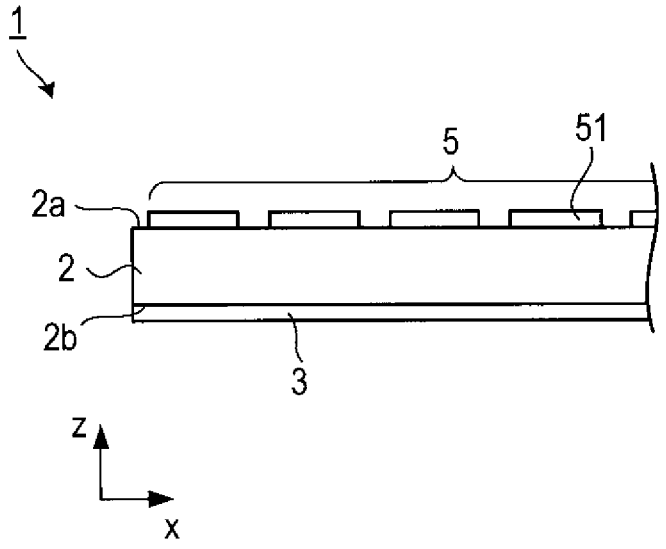
FIG. 2 is a front view illustrating the configuration of the antenna device.

As illustrated in FIG. 1 and FIG. 2, the antenna device 1 includes a dielectric substrate 2 shaped like a rectangle. Both surfaces of the dielectric substrate 2 are used as pattern formation layers. Of the two surfaces of the dielectric substrate 2, a first surface used as a first pattern formation layer is referred to as a substrate front surface 2*a*. Of the two surfaces of the dielectric substrate 2, a second surface used as a pattern formation layer different from the first pattern formation layer is referred to as a substrate back surface 2*b*. A direction along one side of the dielectric substrate 2 is referred to as an x-axis direction. A direction along another side of the dielectric substrate 2 orthogonal to the x-axis direction is referred to as a y-axis direction. A normal direction of the substrate front surface 2*a* is referred to as a z-axis direction.

The antenna device 1 includes a ground plane 3, an antenna unit 4, and additional functional units 3. The ground plane 3 is made as a copper pattern covering the whole of the substrate back surface 2*b* and functions as an antenna grounding surface. The antenna unit 4 is fabricated on a central area of the substrate front surface 2*a*. The additional functional units 3 are disposed on both sides of the substrate front surface 2*a* across the antenna unit 4 in the x-axis direction.

The antenna unit 4 includes a plurality of array antennas arranged along the x-axis direction. Each array antenna includes a plurality of antenna patterns 41 disposed along the y-axis direction and each shaped like a rectangle, and feeder lines 42 through which power is fed to the antenna patterns 41. The antenna unit 4 is configured such that a polarization direction of a radio wave transmitted and received by the antenna unit 4 aligns with the x-axis direction.

Figure 3:
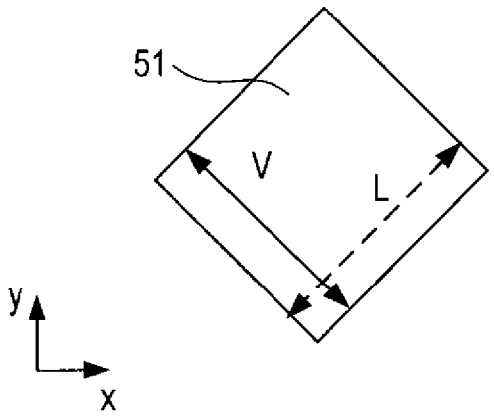
FIG. 3 is a plan view illustrating a configuration of a parasitic pattern.

Each of the additional functional units 5 includes a plurality of parasitic patterns 51 disposed two-dimensionally. As illustrated in FIG. 3, the parasitic patterns 51 are copper patterns each shaped like a rectangle and disposed such that each side of the parasitic pattern 51 is inclined at 45° with respect to the x-axis. Thus, the parasitic pattern 51 resonates, at two sides: a long side and a short side, with a surface wave propagating from the antenna unit 4. Additionally, a size U of the long side of the parasitic pattern 51 and a size V of the short side of the parasitic pattern 51 are set such that a phase difference between resonance at the long side and resonance at the short side (hereinafter referred to as resonant phase difference) corresponds to opposite phases, that is, the phase differs between the long side and the short side by 180°. Additionally, the sizes U and M of sides of the parasitic pattern 51 are set such that the average of the sizes U and M has a larger value than a wavelength Λ at an operating frequency of the antenna device 1. In other words, the resonant frequency corresponding to the average size is set to be lower than the operating frequency of the antenna device 1.

1-2. Design

Here, a method for designing the sizes U and V of the sides of the parasitic pattern 51 will be described.

Figure 4:
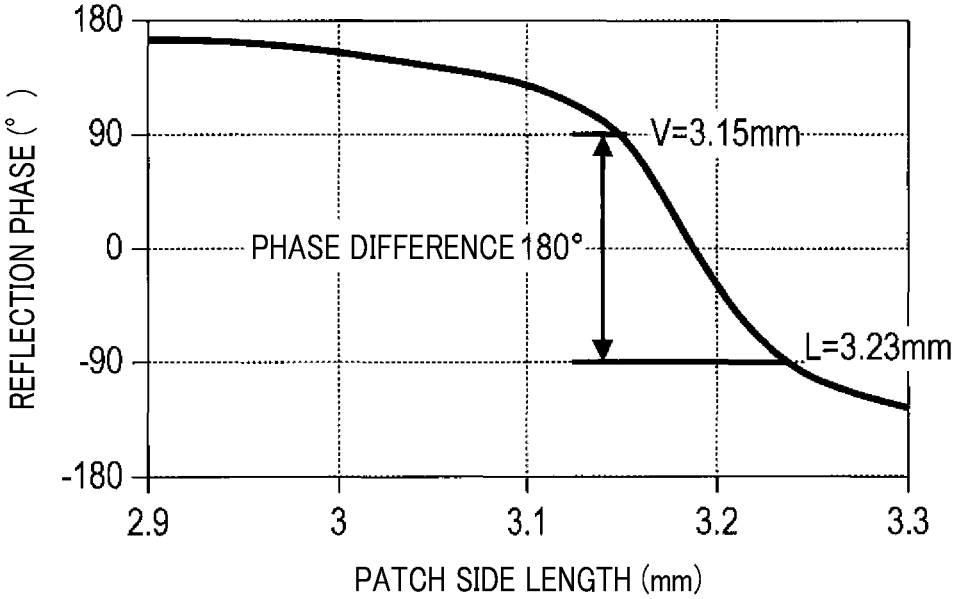
FIG. 4 is a graph illustrating a relationship between the length of a side of the parasitic pattern and a reflection phase at the time of resonance.

FIG. 4 is a graph illustrating a relationship between the size of each side of the parasitic pattern 51 and the phase of a reflected wave from the parasitic pattern 51 measured when a plane wave is incident on the parasitic pattern 51. Here, the incident wave has a frequency of 24.15 GHz, and the parasitic pattern 51 is a square with the size of each side varied. Note that the sizes are determined in simulations on the assumption that the parasitic patterns are infinitely arranged.

FIG. 4 illustrates the size U=3.23 mm and the size V=3.15 mm determined in a case where the average size of the long and short sides of the parasitic pattern 51 is set to be equal to the wavelength Λ at the operating frequency of the antenna device 1. In the present embodiment, U=3.37 mm and V=3.29 mm are set so as to make the average size smaller than the wavelength at the operating frequency.

1-3. Operation

Figure 5:
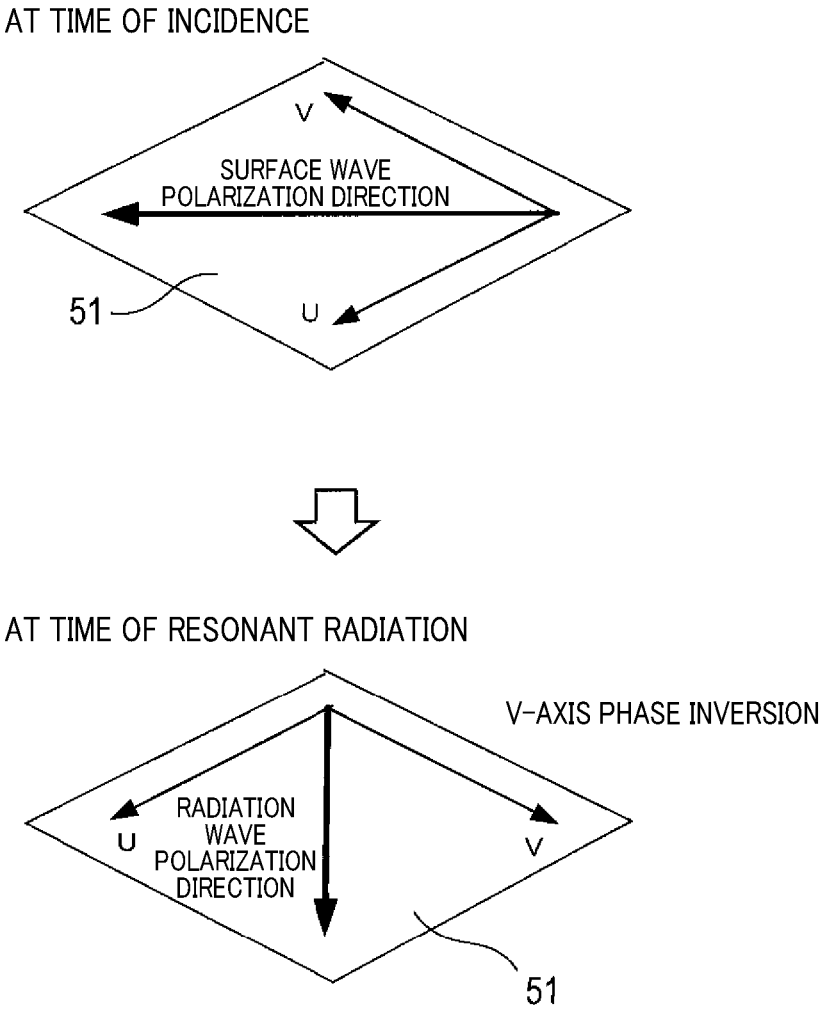
FIG. 5 is an explanatory diagram illustrating operations of the parasitic pattern.

In the antenna device 1 configured as described above, as illustrated in FIG. 5, in a case where a surface wave propagating from the antenna unit 4 and having polarization along the x-axis direction is incident on the parasitic pattern 51, resonance occurs both at the long side and at the short side of the parasitic pattern 51. However, the phase difference between the long side and the short side at the time of resonance corresponds to opposite phases, and thus, a radiation wave that is a radio wave having polarization along the y-axis direction is radiated from the parasitic pattern 51. The surface wave is attenuated greatly by the radiation as the surface wave approaches the edge of the substrate 2.

Figure 6:
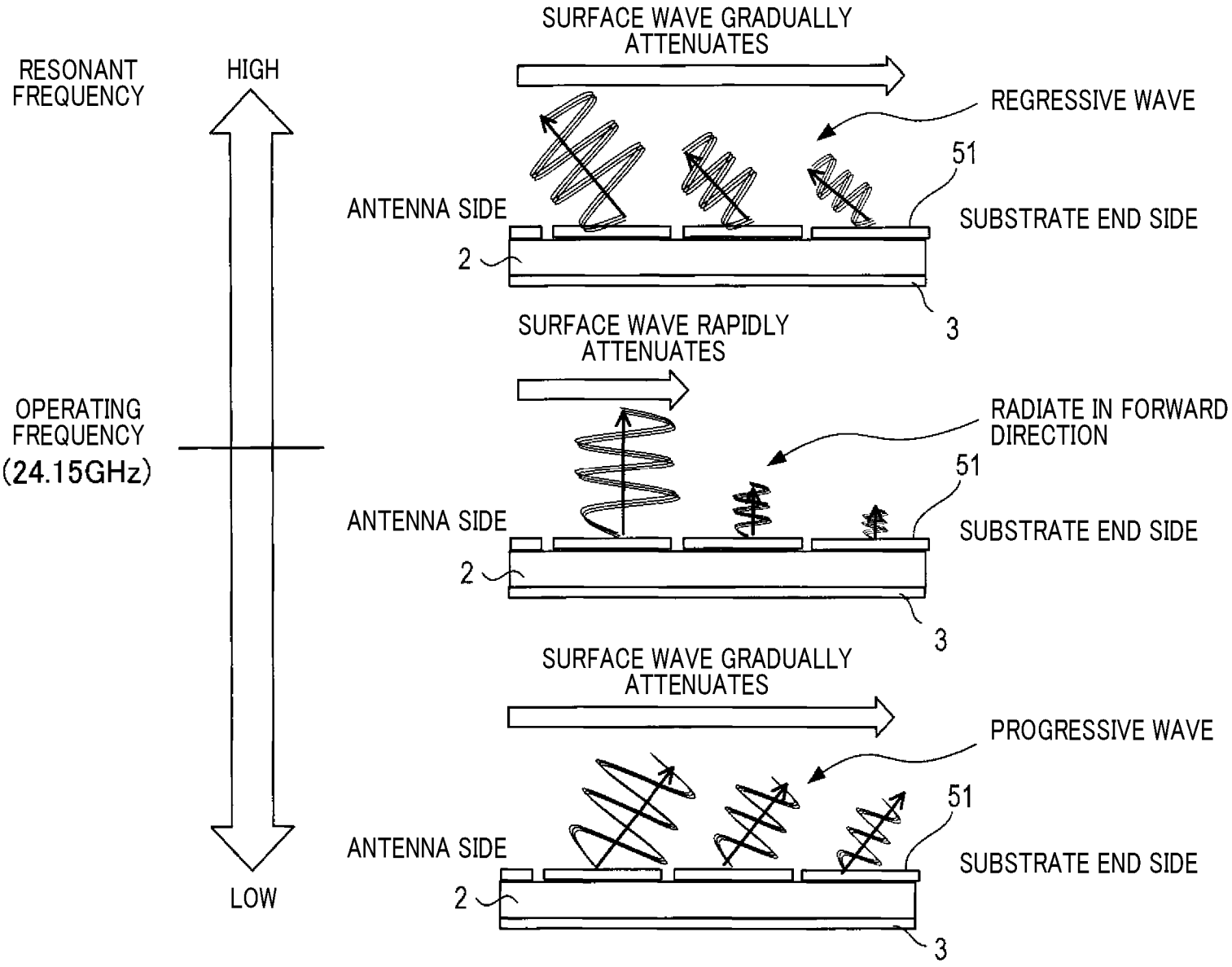
FIG. 6 is an explanatory diagram illustrating effects of variation in a resonant frequency of the parasitic pattern.

Additionally, in the antenna device 1, the resonant frequency corresponding to the average size of both sides of the parasitic pattern 51 is set lower than the operating frequency of the antenna device 1. Thus, as illustrated in FIG. 6, a radiation wave from the parasitic pattern 51 is a progressive wave radiated in a direction in which the surface wave travels. Note that, in a case where the resonant frequency is set equal to the operating frequency, the radiation wave from the parasitic pattern 51 is radiated in a forward direction orthogonal to the substrate front surface 2*a*. Additionally, in a case where the resonant frequency is higher than the operating frequency, the radiation wave from the parasitic pattern 51 is a regressive wave radiated in a direction opposite to the direction in which the surface wave travels. In the present embodiment, the size of the parasitic pattern 51 is set to make the radiation wave progressive. However, the size may be set to radiate the radiation wave in the forward direction or to make the radiation wave regressive.

1-4. Effects

The embodiment described above in detail produces the following effects.

(1a) In the antenna device 1, each of the parasitic patterns 51 belonging to the additional functional unit 5 generates a radiation wave with polarization different from the polarization of the radio wave transmitted and received by the antenna, thus attenuating the surface wave. As a result, the antenna device 1 suppresses unwanted radiations from the substrate ends, allowing implementation of directionality with ripples suppressed.

Figure 7:
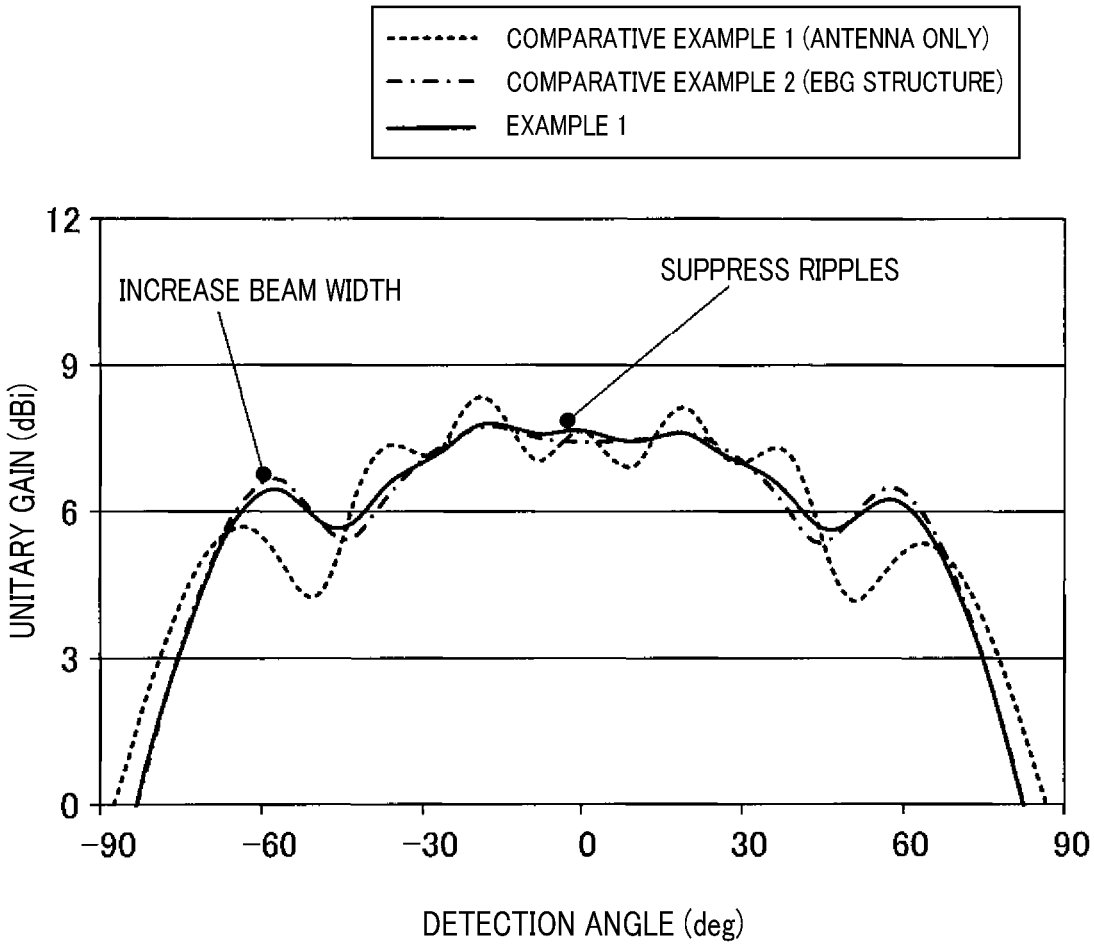
FIG. 7 is a graph illustrating a comparison of directionality between the antenna device of the first embodiment and known devices.

FIG. 7 illustrates the results of calculation of directionality in Example 1 where the antenna device 1 is used, Comparative Example 1 where the additional functional units 5 are not provided, and Comparative Example 2 corresponding to a known device with an EBG. As illustrated in FIG. 7, compared to Comparative Example 1, Example 1 suppresses ripples and produces a ripple suppression effect equivalent to that of Comparative Example 2. In other words, the antenna device 1 can produce effects equivalent to those of the EBG using a simpler configuration than the EBG.

Figure 8:
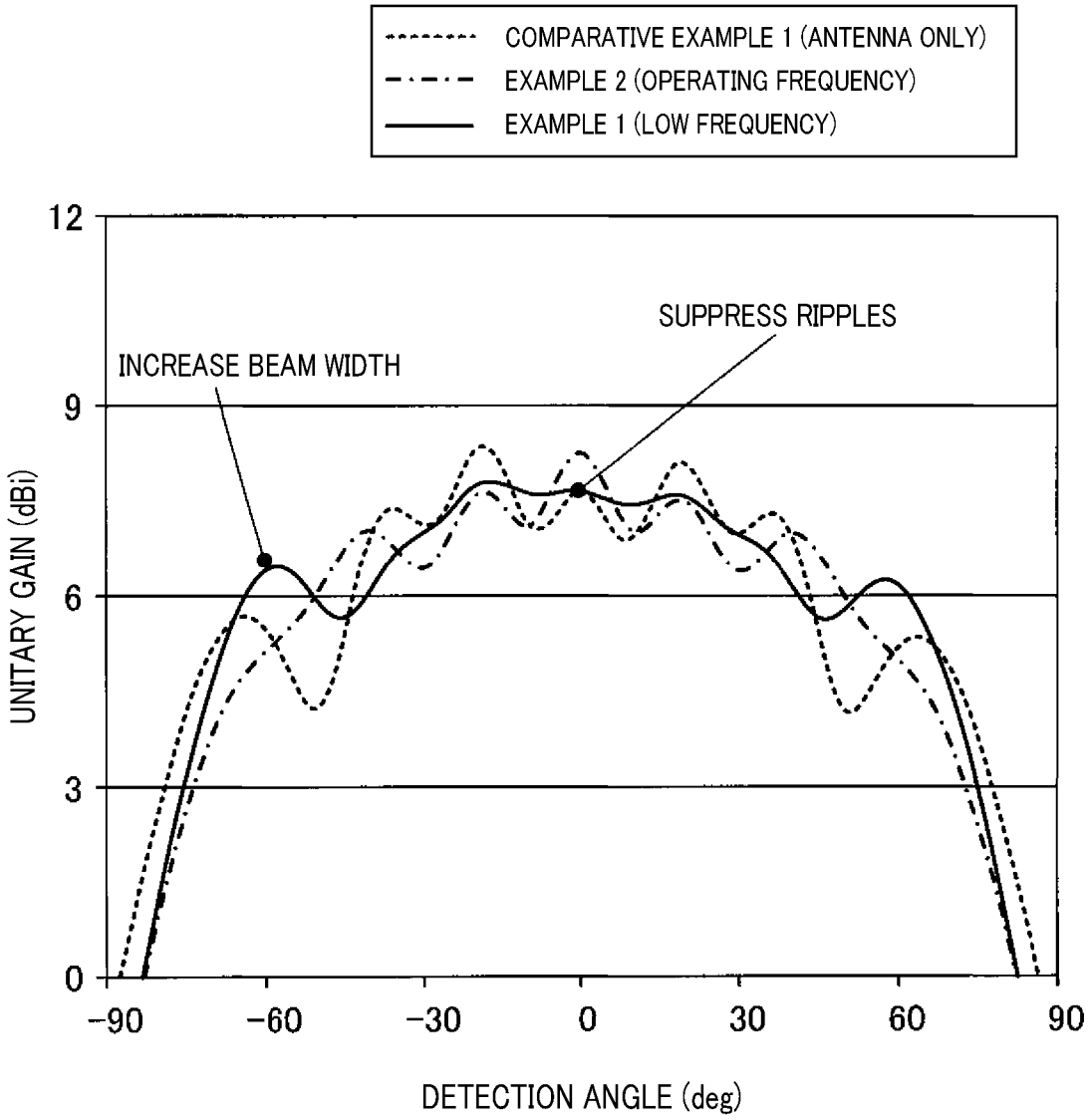
FIG. 8 is a graph illustrating a relationship between the resonant frequency of the parasitic pattern and the directionality of the antenna device.

(1b) In the antenna device 1, the resonant frequency of the parasitic pattern 51 is set lower than the operating frequency of the parasitic pattern 51. This, as demonstrated in FIG. 8, results in a wider beamwidth than Example 2 where the resonant frequency is set equal to the operating frequency.

1-5. Modifications

Figure 9:
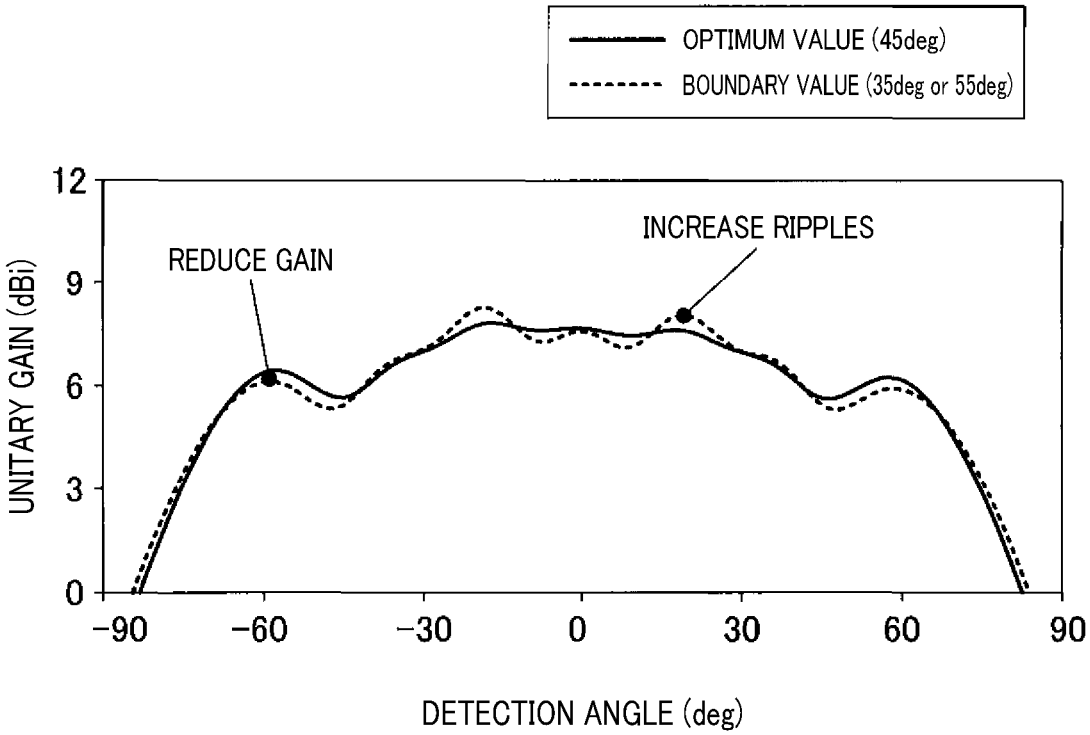
FIG. 9 is a graph illustrating a relationship between the inclination of arrangement of the parasitic pattern and the directionality of the antenna device.

In the above-described embodiment, the parasitic pattern 51 is disposed such that each side is inclined at 45° with respect to the x-axis. However, the present disclosure is not limited to this. For example, effects similar to those of the above-described embodiment can be produced as long as the inclination of each side of the parasitic pattern 51 is in the range of 45°±10°, that is, approximately from 35° to 55°, as illustrated in FIG. 9.

Figure 10:
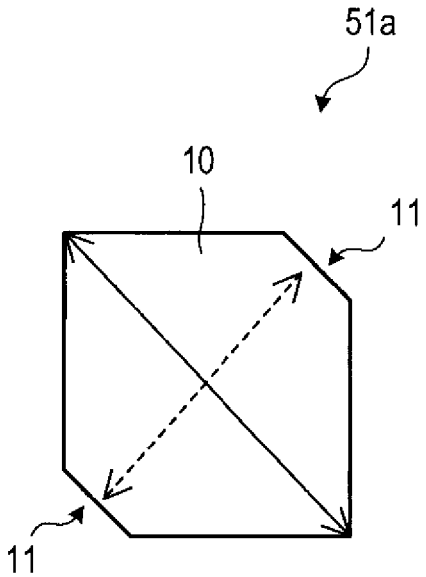
FIG. 10 is an explanatory diagram illustrating another pattern shape of the parasitic pattern.
Figure 11:
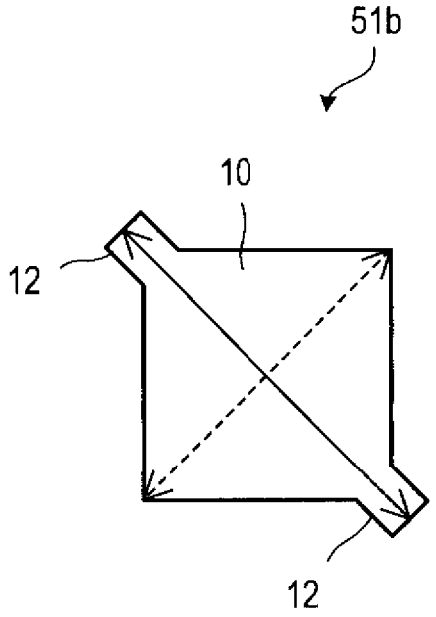
FIG. 11 is an explanatory diagram illustrating another pattern shape of the parasitic pattern.

In the above-described embodiment, the pattern shape of the parasitic pattern 51 is a rectangle. However, the present disclosure is not limited to this. For example, as in a parasitic pattern 51*a* illustrated in FIG. 10, the pattern shape may include a main portion 10 shaped like a square and cutout portions 11 formed at both ends of a first diagonal line that is one of two diagonal lines of the main portion 10. Additionally, as in a parasitic pattern 51*b* illustrated in FIG. 11, the pattern shape may include protruding portions 12 at both ends of the first diagonal line of the main portion 10. In these cases, when a surface wave is incident on the parasitic pattern 51*a* or 51*b*, the parasitic pattern 51*a* or 51*b* resonates along the two diagonal lines as illustrated by arrows in FIG. 10 and FIG. 11. Thus, the parasitic patterns 51*a* and 51*b* may be disposed such that the two diagonal lines are both inclined with respect to the x-axis.

Figure 12:
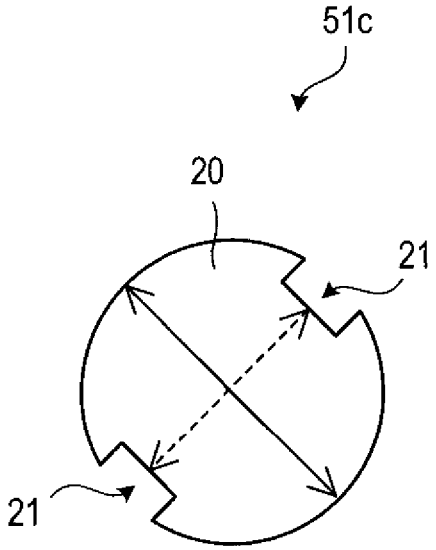
FIG. 12 is an explanatory diagram illustrating another pattern shape of the parasitic pattern.

Additionally, for example, as in a parasitic pattern 51*c* illustrated in FIG. 12, the pattern shape may include a main portion 20 shaped like a circle and cutout portions 21 formed at both ends of a first center line that is one of two center lines that are orthogonal to each other and that pass through the center of the main portion 20. In this case, when a surface wave is incident on the parasitic pattern 51*c*, the parasitic pattern 51 resonates along the two center lines as illustrated by arrows in FIG. 12. Thus, the parasitic pattern 51*c* may be disposed such that the two center lines are both inclined with respect to the x-axis. Additionally, protruding portions may be provided instead of the cutout portions 21.

Figure 13:
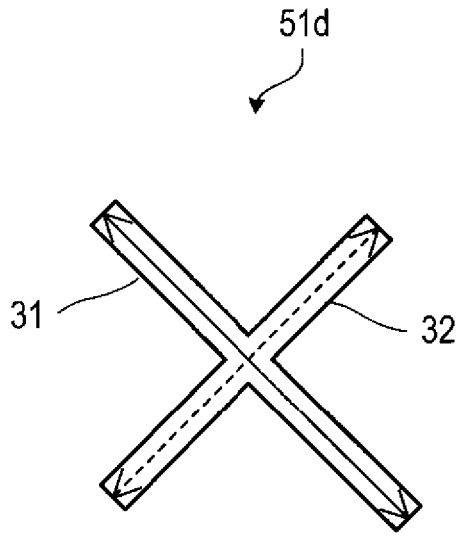
FIG. 13 is an explanatory diagram illustrating another pattern shape of the parasitic pattern.

Additionally, for example, as in a parasitic pattern 51*d* illustrated in FIG. 13, the pattern shape may include two linear patterns 31 and 32 intersecting with each other. In this case, when a surface wave is incident on the parasitic pattern 51*d*, the parasitic pattern 51*d* resonates along the two linear patterns 31 and 32. Thus, the parasitic pattern 51*d* may be disposed such that longitudinal directions of the two linear patterns 31 and 32 are both inclined with respect to the x-axis.

The parasitic pattern is not limited to the above-described pattern shapes. Any pattern shape may be used as long as the pattern shape allows resonance to occur at two positions and enables the resonant phase difference to be adjusted. For example, the parasitic pattern may be implemented by adjusting the resonant phase difference to 180° rather than to 90° according to well-known pattern shapes causing circular polarization.

In the above-described embodiment, the parasitic pattern 51 is configured to emit a radiation wave having a polarization direction different from that of the surface wave by 90°. However, the present disclosure is not limited to this. The parasitic pattern 51 may have any configuration as long as the polarization direction of the surface wave does not align with the polarization direction of the radiation wave. For example, the parasitic pattern 51 may be configured such that the radiation wave corresponds to circular or elliptic polarization.

2. Second Embodiment

2-1. Differences from First Embodiment

A second embodiment is basically configured similarly to the first embodiment, and thus, differences will be described. Note that the same reference signs as those in the first embodiment denote the same components and that the above description of these components will be referenced.

The second embodiment differs from the first embodiment in the configuration of an antenna unit 7, the arrangement of an additional functional unit 8, and the shape of parasitic patterns 81 belonging to the additional functional unit 8.

Figure 14:
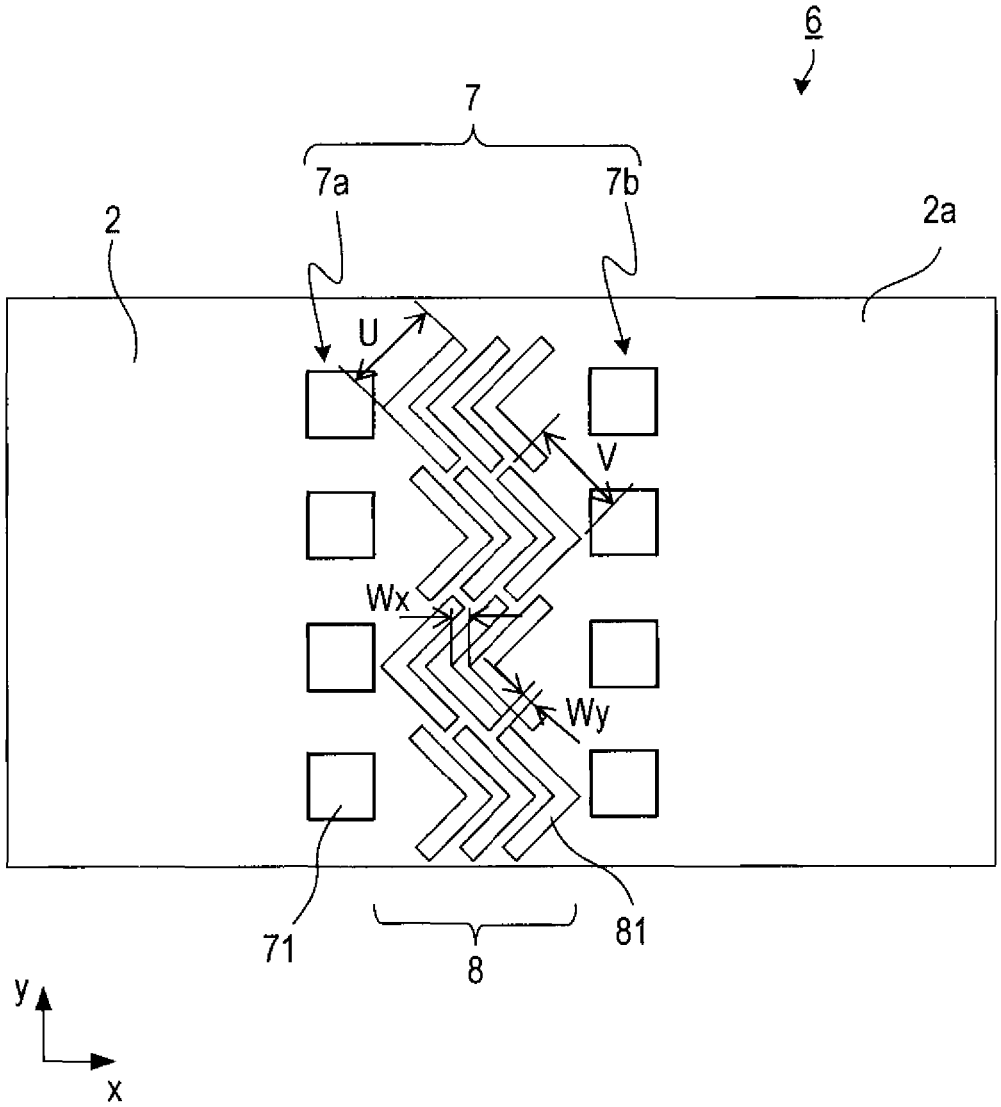
FIG. 14 is a plan view illustrating a configuration of an antenna device of a second embodiment.

As illustrated in FIG. 14, an antenna device 6 of the second embodiment includes the dielectric substrate 2. The antenna device 6 includes the ground plane 3 on the substrate back surface 2*b* and an antenna unit 7 and an additional functional unit 8 on the substrate front surface 2*a*.

The antenna unit 7 includes two array antennas 7*a* and 7*b* arranged along the x-axis direction. Each of the array antennas 7*a* and 7*b* includes a plurality of antenna patterns 71 disposed along the y-axis direction and each shaped like rectangle. The array antennas 7*a* and 7*b* are disposed such that the antenna patterns 71 belonging to each array antenna are aligned with one another along the x-axis direction. Additionally, although not illustrated, power feeding for the antenna patterns 71 is performed such that the polarization direction of a transmitted and received radio wave aligns with the x-axis direction. Each of the array antennas 7*a* and 7*b* is hereinafter referred to as a channel. One of the channels may be used for transmission and the other may be used reception, or both of the channels may be used for transmission or reception.

The additional functional unit 8 is disposed between the two array antennas 7*a* and 7*b*. The additional functional unit 8 includes a plurality of parasitic patterns 81 disposed two-dimensionally. Each of the parasitic patterns 81 includes two copper patterns linearly formed (hereinafter referred to as linear patterns) coupled together at an angle of 90° in an L-shape. Each linear pattern is disposed to incline at 45° from the x-axis. The two linear patterns are different from each other in longitudinal size. The longer linear pattern is hereinafter referred to as a long side, and the shorter linear pattern is hereinafter referred to as a short side. The size U of the long side and the size V of the short side are set such that the phase difference between resonance at the long side and resonance at the short side (hereinafter referred to as resonant phase difference) corresponds to opposite phases, that is, the phase differs between the long side and the short side by 180°.

Additionally, in the additional functional unit 8, the plurality of parasitic patterns 81 provided along the x-axis direction are disposed such that coupling portions each between the two linear patterns face in the same direction. Additionally, the plurality of parasitic patterns 81 provided along the y-axis direction are disposed such that the direction of the coupling portion alternately changes. Furthermore, the plurality of parasitic patterns 81 provided along the x-axis direction are disposed such that the coupling portions are positioned on a line connecting the centers of the antenna patterns 71 aligned with each other in the x-axis direction.

2-2. Operation

In the antenna device 6 configured as described above, when a surface wave propagating between the array antennas 7*a* and 7*b* enters each of the parasitic patterns 81, the parasitic pattern 81 resonates at the two linear patterns, that is, both at the long side and at the short side. Since the phases between the long side and the short side are 180° out of phase with each other (i.e., in opposite phases) at the time of resonance, the parasitic pattern 81 radiates a radio wave having polarization oriented in the y-axis direction. The radiation attenuates the surface wave. Additionally, the radiated wave differs from a transmitted or received wave in polarization plane by 90°, the transmitted or received wave being a radio wave transmitted or received by the antenna unit 7, thus resulting in no interference of the radiated wave with the transmitted or received wave.

2-3. Effects

The second embodiment described above in detail produces the following effects.

(2a) In the antenna device 6, the parasitic patterns 81 belonging to the additional functional unit 8 attenuate the surface wave propagating between the array antennas 7*a* and 7*b*, thus allowing inter-channel isolation to be improved.

Figure 15:
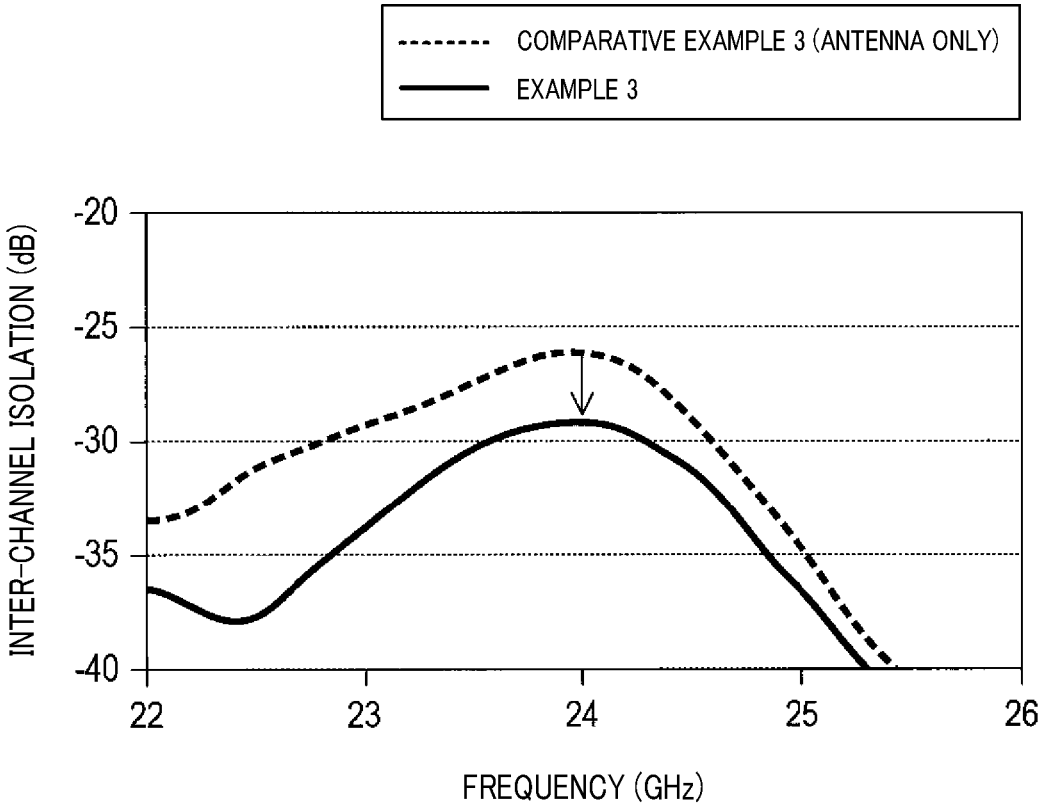
FIG. 15 is a graph illustrating a comparison of inter-channel isolation between the antenna device of the second embodiment and a known device.

As illustrated in FIG. 15, compared to Comparative Example 3 in which the additional functional unit 8 is omitted from the configuration of the antenna device 6, Example 3 equipped with the antenna device 6 improves inter-channel isolation over a wide range around 24 GHz, which is the operating frequency. Note that the graph in FIG. 15 illustrates results of simulations in which the size U of the long side of the parasitic pattern 81 is 3.2 mm, the size V of the short side of the parasitic pattern 81 is 3.21 mm, an arrangement interval Wx between the adjacent parasitic patterns 81 in the x-axis direction is 0.3 mm, and an arrangement interval Wy between ends in the y-axis direction is 0.25 mm.

2-4. Modified Example

In the additional functional unit 8 in the antenna device 6, the parasitic patterns 81 arranged in the y-axis direction are disposed such that the direction of the coupling portion alternately changes. However, the present disclosure is not limited to this.

Figure 16:
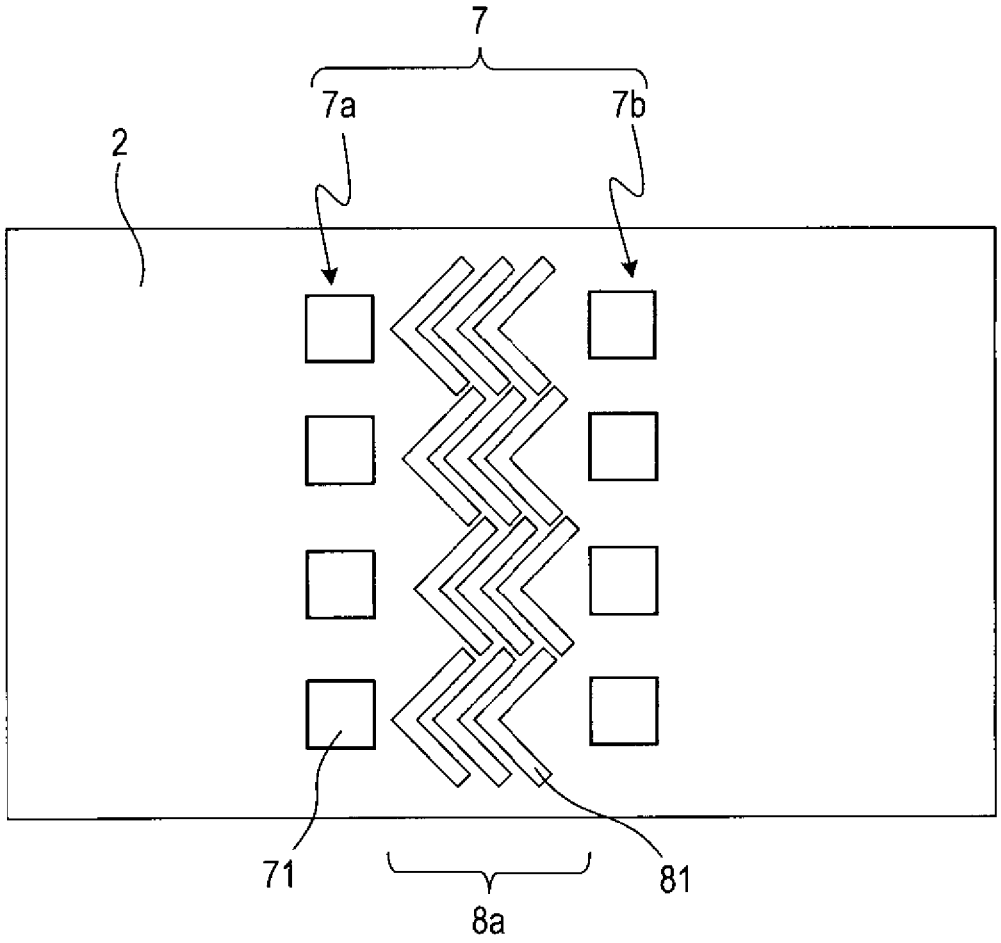
FIG. 16 is an explanatory diagram illustrating another configuration of an additional functional unit.

For example, as in an additional functional unit 8*a* illustrated in FIG. 16, the parasitic patterns 81 arranged in the y-axis direction may also be disposed such that the coupling portions face in the same direction.

Figure 17:
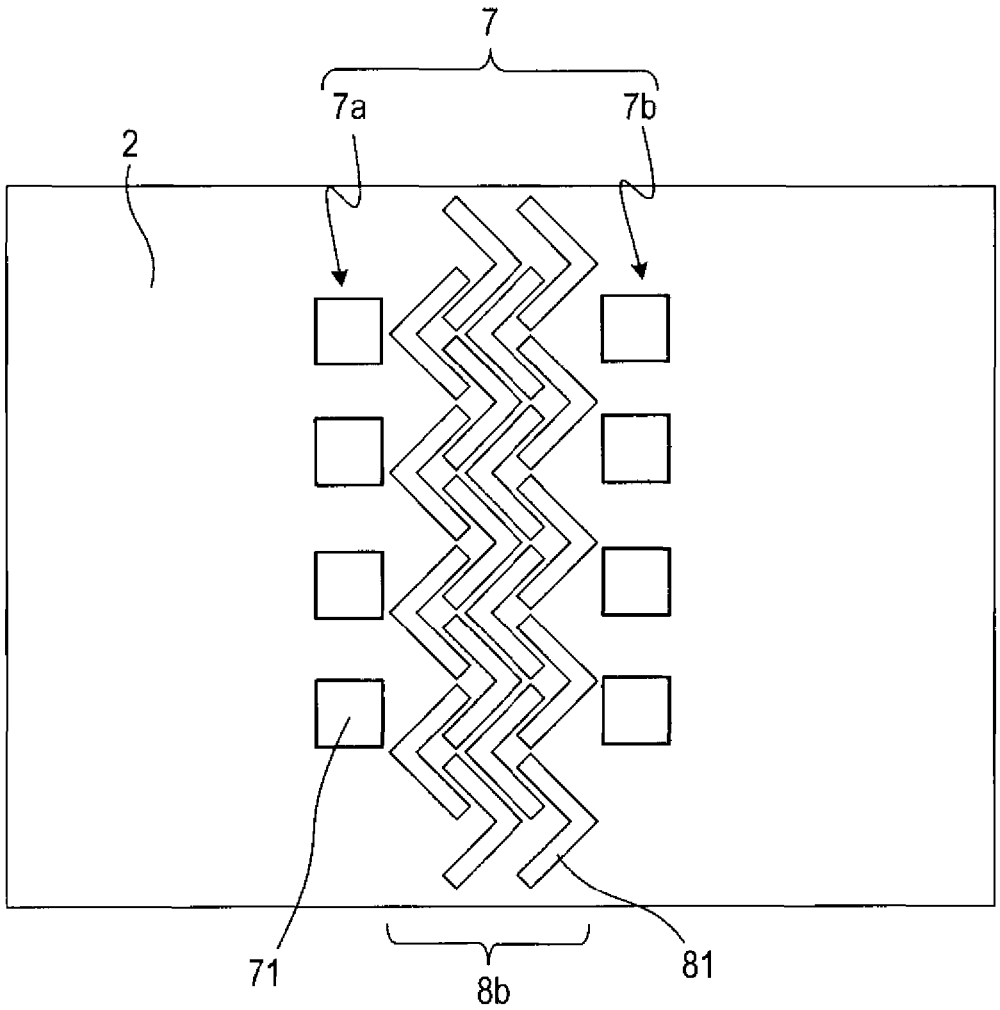
FIG. 17 is an explanatory diagram illustrating another configuration of the additional functional unit.

Additionally, as in an additional functional unit 8*b* illustrated in FIG. 17, the arrangement of the parasitic patterns 81 in the additional functional unit 8*a* may be used as a base, the plurality of parasitic patterns 81 arranged in the y-axis direction may be designated as a pattern row, and a plurality of the pattern rows arranged in the x-axis direction may be alternately laterally inverted and displaced from one another, in the y-axis direction, by a distance that is half the size of the parasitic pattern 81 in the y-axis direction.

Figure 18:
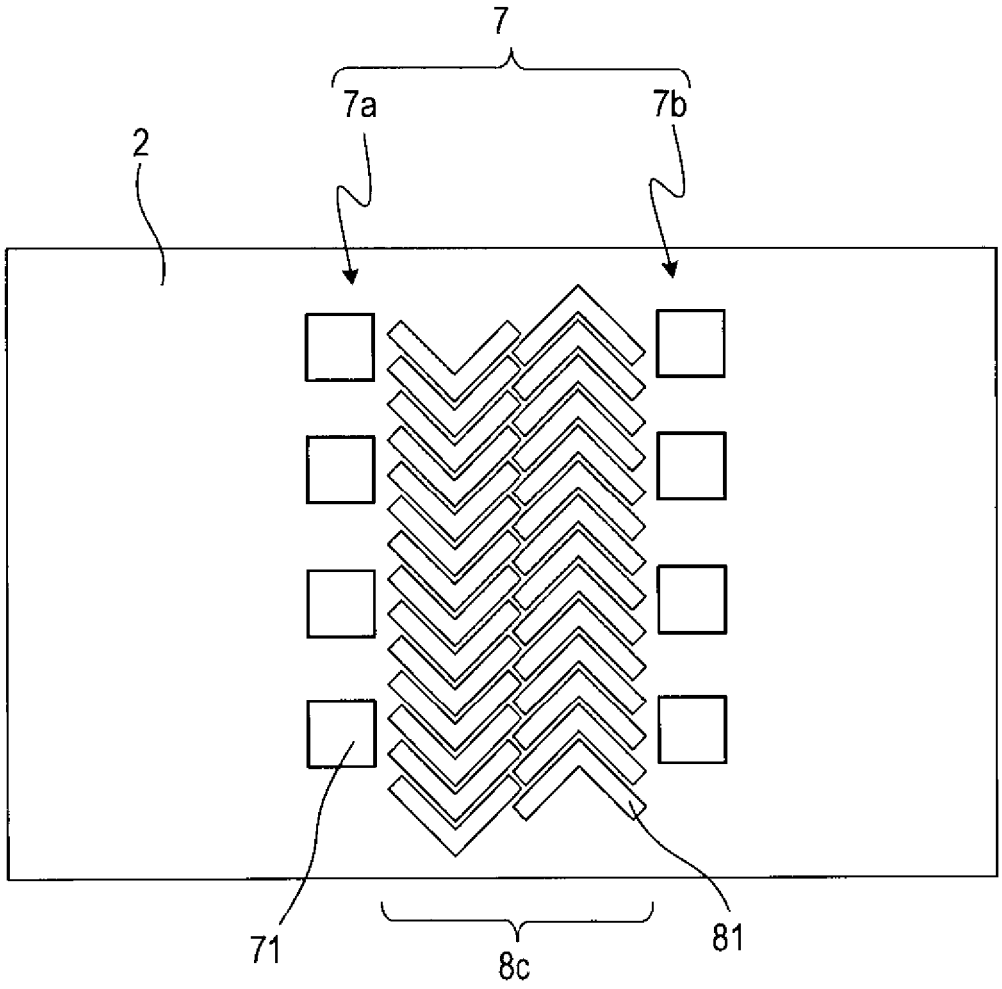
FIG. 18 is an explanatory diagram illustrating another configuration of the additional functional unit.

Additionally, as illustrated in FIG. 18, the arrangement of the parasitic patterns 81 may be rotated through 90° such that the coupling portions of the parasitic patterns 81 are disposed to protrude in the y-axis direction.

In the above-described antenna device 6, as the additional functional unit 8, the parasitic patterns 81 each with the L pattern shape are used. However, the present disclosure is not limited to this.

Figure 19:
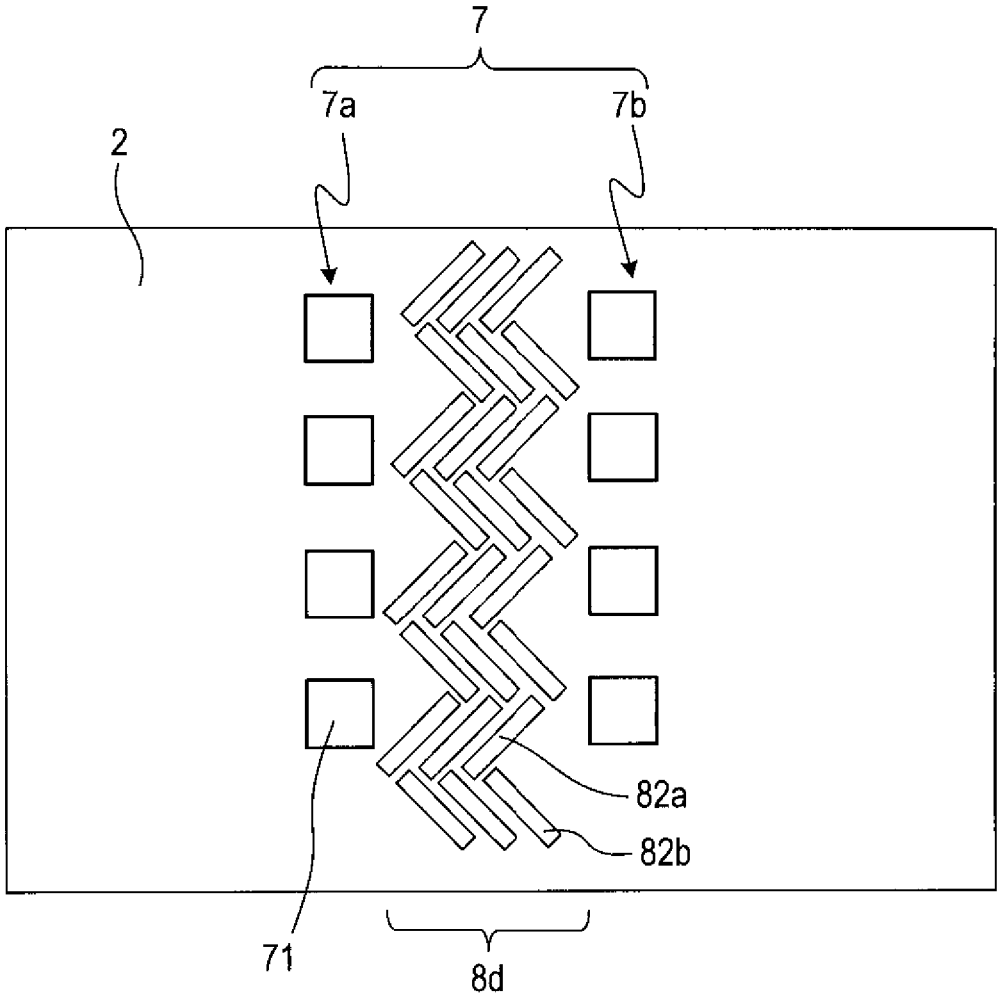
FIG. 19 is an explanatory diagram illustrating another configuration of the additional functional unit.

For example, as in an additional functional unit 8*d* illustrated in FIG. 19, two types of linear parasitic patterns 82*a* and 82*b* having different lengths may be used. In this case, the two parasitic patterns 82*a* and 82*b* disposed in an L-shape may be designated as a unit block, and the unit blocks may be disposed as is the case with the parasitic patterns 81 in the additional functional units 8, 8*a*, and 8*b*. FIG. 19 illustrates arrangement similar to that in the additional functional unit 8*a*.

Figure 20:
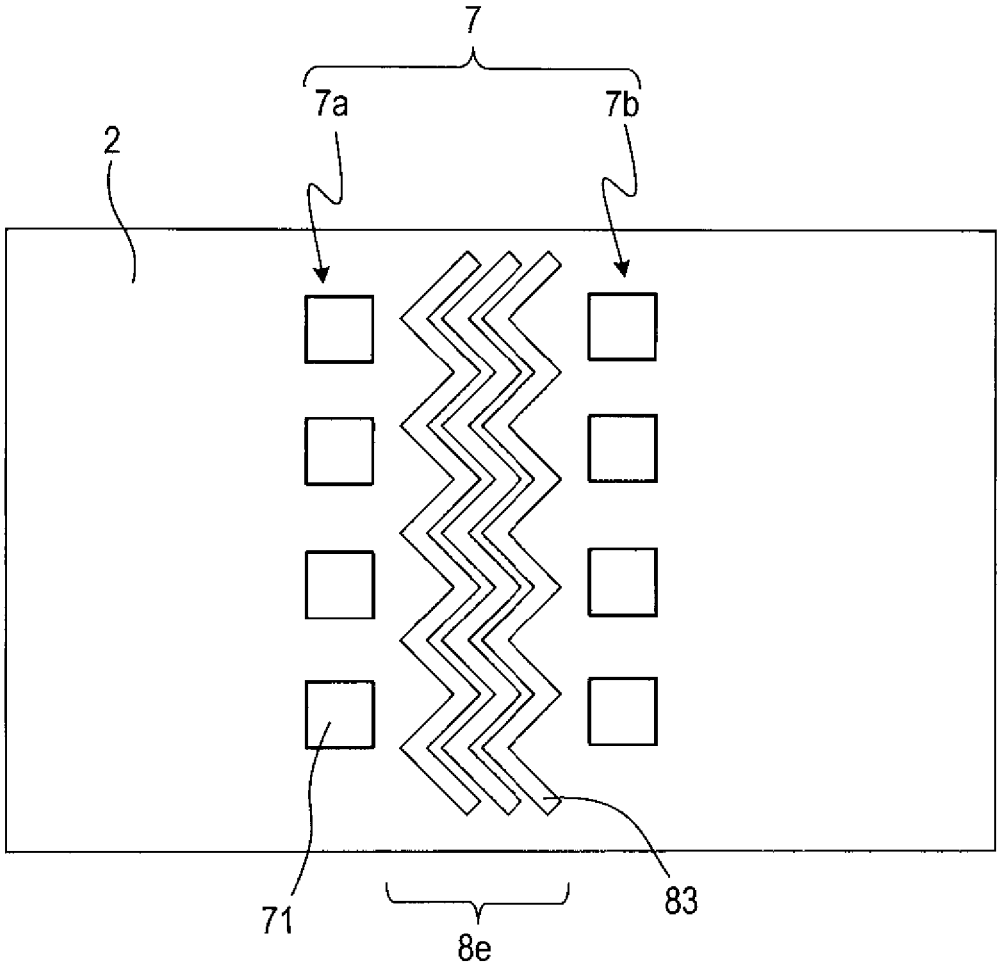
FIG. 20 is an explanatory diagram illustrating another configuration of the additional functional unit.

Additionally, as in an additional functional unit 8*e* illustrated in FIG. 20, the arrangement of the parasitic patterns 81 in the additional functional unit 8*a* may be used as a base, and a plurality of parasitic patterns 83 may be arranged in the x-axis direction, the parasitic patterns 83 each having a pattern shape in which the plurality of parasitic patterns 81 arranged in the y-axis direction are all coupled together. Furthermore, the plurality of parasitic patterns 83 in the additional functional unit 8*e* may be rotated through 90°.

3. Other Embodiments

Various embodiments of the present disclosure have been discussed. The present disclosure is, however, not limited to the above-described embodiments and may be variously modified for implementation.

Figure 21:
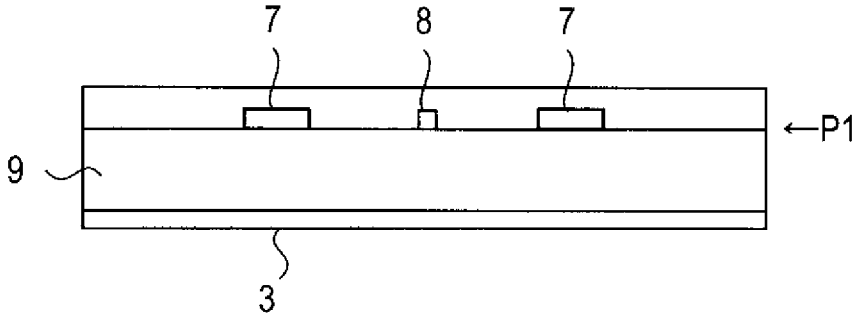
FIG. 21 is an explanatory diagram illustrating arrangement of the antenna unit and the additional functional unit on a multilayer dielectric substrate.
Figure 22:
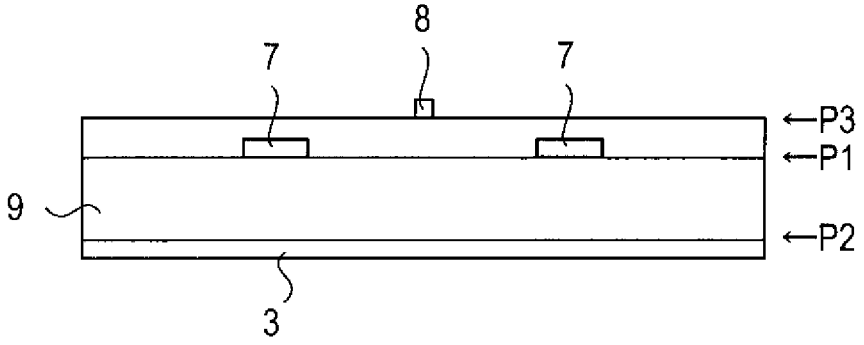
FIG. 22 is an explanatory diagram illustrating arrangement of the antenna unit and the additional functional unit on a multilayer dielectric substrate.
Figure 23:
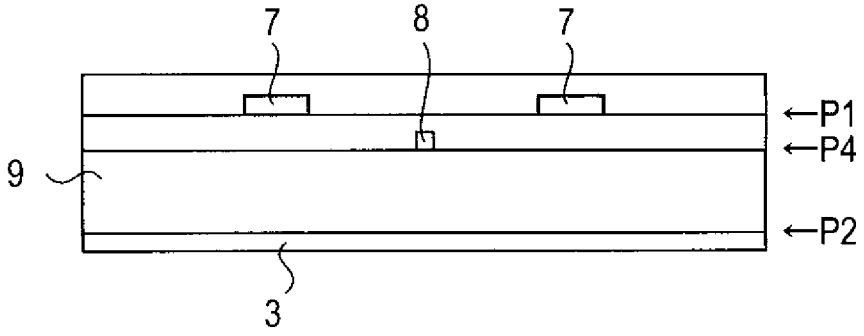
FIG. 23 is an explanatory diagram illustrating arrangement of the antenna unit and the additional functional unit on a multilayer dielectric substrate.

(3a) In the examples in the above-described embodiments, the single-layer dielectric substrate 2 is used. However, the present disclosure is not limited to this, and a multilayer dielectric substrate 9 may be used. In this case, for example, as illustrated in FIG. 21, the antenna units 7 (that is, the antenna patterns 71) and the additional functional unit 8 (that is, the parasitic patterns 81) may be provided on a pattern formation layer P1 positioned inside the dielectric substrate 9. Additionally, for example, as illustrated in FIG. 22 and FIG. 23, the antenna unit 7 and the additional functional unit 8 may be provided in separate pattern formation layers. In this case, as illustrated in FIG. 22, the additional functional unit 8 may be provided on a pattern formation layer P3 positioned opposite to the pattern formation layer P2 across the pattern formation layer P1 with the antenna units 7. Additionally, as illustrated in FIG. 23, the additional functional unit 8 may be provided on a pattern formation layer P4 positioned between the pattern formation layer P1 with the antenna units 7 and the pattern formation layer P2 with the ground plane 3. Note that, in FIGS. 21 to 23, the antenna units 7 and the additional functional unit 8 are used for description but that instead of the antenna units 7 and the additional functional unit 8, the antenna units 4 and the additional functional unit 5 may be used.

(3b) In the above-described embodiments, the parasitic patterns 51 and 51*a* to 51*d* are illustrated in the first embodiment, and the parasitic patterns 81, 82*a*, 82*b*, and 83 are illustrated in the second embodiment. However, the parasitic patterns 81, 82*a*, 82*b*, or 83 may be used for the first embodiment, and the parasitic patterns 51, 51*a*, 51*b*, 51*c*, or 51*d* may be used for the second embodiment.

(3c) A plurality of functions of one component in the above-described embodiments may be implemented by a plurality of components or one function of one component may be implemented by a plurality of components. Additionally, a plurality of functions of a plurality of components may be implemented by one component or one function provided by a plurality of components may be implemented by one component. In addition, a part of the configuration of each of the above-described embodiments may be omitted. Additionally, at least a part of the configuration of each of the above-described embodiments may be added to or replaced with the configuration of any other of the above-described embodiments. Note that all aspects included in technical concepts identified by the language recited in claims are embodiments of the present disclosure.

(3d) Besides the above-described antenna device, the present disclosure can be implemented in various forms such as a system including the antenna device as a component and a method for adjusting antenna directionality.

What is claimed is:

1. An antenna device comprising:

a dielectric substrate which has opposing pattern formation layers;

a ground plane formed on a bottom layer of the opposing pattern formation layers, the ground plane functioning as an antenna grounding surface of the antenna device;

an antenna unit formed on a top layer of the opposing pattern formation layers, the antenna unit including a plurality of radiation elements each having an antenna pattern; and a functional unit which includes a plurality of co-planar parasitic patterns provided on a propagation path of a surface wave propagating over the dielectric substrate, the functional unit being configured to generate a radiation wave with a first polarization different from a second polarization of a radio wave transmitted or received by the antenna unit; wherein:

each of the parasitic patterns of the functional unit is shaped to have a long side and a short side, the long side and the short side resonating independently from each other to suppress disturbance radiation on a surface of the dielectric substrate, the plurality of radiation elements of the antenna unit are at least partially aligned with the parasitic patterns of the functional unit in a polarization direction in which a radio wave is transmitted from or received by the antenna unit, and the plurality of radiation elements are geometrically different from the parasitic patterns of the functional unit.

2. The antenna device according to claim 1, wherein the functional unit is disposed on a side of the antenna unit.

3. The antenna device according to claim 1, wherein the functional unit is disposed between the plurality of radiation elements.

4. The antenna device according to claim 1, wherein each of the plurality of parasitic patterns has a pattern shape in which is shaped such that the parasitic pattern resonates in two directions inclined with respect to the polarization direction of the radio wave transmitted or received by the antenna unit.

5. The antenna device according to claim 4, wherein each of the parasitic patterns has a rectangular shape and resonates along sides of the rectangle.

6. The antenna device according to claim 4, wherein each of the plurality of parasitic patterns has a shape that includes a main portion shaped like a square and protruding portions or cutout portions formed on or in both ends of a first diagonal line that is one of two diagonal lines of the main portion, the parasitic pattern being configured to resonate along the two diagonal lines.

7. The antenna device according to claim 4, wherein each of the plurality of parasitic patterns has a shape that includes a main portion shaped like a circle and protruding portions or cutout portions formed at both ends of a first center line that is one of two center lines that are orthogonal to each other and that pass through a center of the main portion, the parasitic pattern being configured to resonate along the two center lines.

8. The antenna device according to claim 4, wherein each of the plurality of parasitic patterns has a shape that includes two intersecting linear patterns and is configured to resonate along the two linear patterns.

9. The antenna device according to claim 4, wherein each of the plurality of parasitic patterns has a shape that includes two linear patterns coupled together in an L-shape and is configured to resonate along the two linear patterns.

10. The antenna device according to claim 4, wherein each of the plurality of parasitic patterns has a shape that includes a plurality of unit patterns coupled together and each including two linear patterns coupled together in an L-shape, the parasitic pattern being configured to resonate along each of the two linear patterns.

11. The antenna device according to claim 1, wherein each of the plurality of parasitic patterns includes two types of linear patterns configured to incline with respect to the polarization direction of the radio wave transmitted or received by the antenna unit and to resonate in different directions.

12. The antenna device according to claim 11, wherein the functional unit includes one or more unit blocks each defined by the two types of linear patterns disposed in an L-shape.

13. The antenna device according to claim 4, wherein the plurality of parasitic patterns are configured to resonate at a frequency lower than an operating frequency of the antenna unit.

14. The antenna device according to claim 4, wherein the plurality of parasitic patterns are configured such that two resonances have opposite phases.

15. The antenna device according to claim 4, wherein the plurality of parasitic patterns are configured such that resonance directions of the two resonances phases are orthogonal to each other.

16. The antenna device according to claim 15, wherein the plurality of parasitic patterns are disposed such that the resonance directions of the two resonances are each inclined at 35° to 55° with respect to the polarization direction of the radio wave transmitted or received by the antenna unit.

17. The antenna device according to claim 1, wherein the dielectric substrate includes three or more pattern formation layers, and the functional unit is disposed on a pattern formation layer positioned, with respect to the bottom layer, on a same side as that on which the top layer is located, and the pattern formation layer on which the functional unit is disposed is different from the top layer.

* * * * *